US009861167B2

(12) United States Patent
Shirai et al.

(10) Patent No.: US 9,861,167 B2
(45) Date of Patent: Jan. 9, 2018

(54) ORNAMENT HOLDER

(71) Applicant: CLOVER MFG. CO., LTD., Osaka-shi, Osaka (JP)

(72) Inventors: Rie Shirai, Osaka (JP); Atsushi Tanaka, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 317 days.

(21) Appl. No.: 14/704,336

(22) Filed: May 5, 2015

(65) Prior Publication Data

US 2015/0335103 A1 Nov. 26, 2015

(30) Foreign Application Priority Data

May 20, 2014 (JP) ..... 2014-104771

(51) Int. Cl.
*A44B 1/12* (2006.01)
*A44B 1/04* (2006.01)
(Continued)

(52) U.S. Cl.
CPC ..... *A44B 1/123* (2013.01); *A44B 1/04* (2013.01); *A44B 1/24* (2013.01); *A44B 1/34* (2013.01);
(Continued)

(58) Field of Classification Search
CPC .. A44B 1/123; A44B 1/04; A44B 1/24; A44B 1/34; A44B 1/08; A44B 17/0029;
(Continued)

(56) References Cited

U.S. PATENT DOCUMENTS 4,040,148 A * 8/1977 Fukumoto ..... A44B 1/34 24/108
4,969,241 A * 11/1990 Griffin ..... A44B 1/14 24/113 MP
(Continued)

FOREIGN PATENT DOCUMENTS

DE 2244633 A1 * 4/1974 ..... A44B 1/32
DE 2608907 A1 * 9/1977 ..... A44B 17/0029
(Continued)

OTHER PUBLICATIONS

Office Action issued in counterpart Japanese Patent Application No. 2014-104771, dated Jan. 19, 2016.

*Primary Examiner* — Robert Sandy
*Assistant Examiner* — Matthew J Sullivan
(74) *Attorney, Agent, or Firm* — Hamre, Schumann, Mueller & Larson, P.C.

(57) ABSTRACT

An ornament holder includes a frame body and a presser plate attachable to the frame body. The frame body includes a plate-like portion and locking shafts extending upright from the first plate-like portion. The presser plate is formed with a hole into which the locking shafts are inserted for attaching the presser plate to the frame body. The locking shafts include horizontally protruding locking portions. The presser plate includes locked portions adjacent to the hole and configured to engage with the locking portions of the locking shafts The locking shafts are elastically deformable so as to approach each other when being inserted into the hole of the presser plate.

6 Claims, 10 Drawing Sheets

(51) Int. Cl.
*A44B 1/24* (2006.01)
*A44B 1/34* (2006.01)

(52) U.S. Cl.
CPC ..... *Y10T 24/3497* (2015.01); *Y10T 24/45508* (2015.01)

(58) Field of Classification Search
CPC ..... Y10T 24/3497; Y10T 24/45508; Y10T 24/3672; Y10T 24/45775
See application file for complete search history.

(56) References Cited

U.S. PATENT DOCUMENTS

| | | | | |
|---|---|---|---|---|
| 8,522,404 | B2 * | 9/2013 | Matei | A44B 1/28 24/104 |
| 2010/0251459 | A1 * | 10/2010 | Schlesinger | A41F 17/02 2/232 |

FOREIGN PATENT DOCUMENTS

| | | | | |
|---|---|---|---|---|
| GB | 831563 | A * | 3/1960 | A44B 1/34 |
| JP | 62-64311 | U | 4/1987 | |
| JP | 6-225803 | A | 8/1994 | |

* cited by examiner

ORNAMENT HOLDER

BACKGROUND OF THE INVENTION

1. Field of the Invention

The present invention relates to an ornament holder, such as a covered button, that is used while holding an ornament.

2. Description of Related Art

Conventionally, in the fields of handicrafts and the like, a covered button that is used while holding an ornament such as a decorative fabric is known (see JP-U-A-S62-64311, for example). The covered button disclosed in JP-U-A-S62-64311 includes a frame main body having a shaft portion at its center and a presser plate having at its center a hole into which this shaft portion is to be fitted. The shaft portion is provided with a locking step portion. Moreover, the frame main body has a rising wall at its peripheral edge, and a plurality of locking protrusions are provided on an inner side surface of the rising wall.

To use the covered button disclosed in JP-U-A-S62-64311, for example, a surface of the frame main body is covered with a decorative fabric, and a peripheral edge portion of the decorative fabric is folded over the inner side surface of the rising wall. Then, the presser plate is placed with its lower peripheral edge facing downward, the hole is fitted to the shaft portion of the frame main body, and the presser plate is forcibly pushed downward into place. In this manner, the presser plate is attached to the frame main body. In a state in which the presser plate is attached, an annular wall surrounding the hole of the presser plate engages with the locking step portion of the shaft portion, thereby restricting the upward movement of the presser plate, and the lower peripheral edge of the presser plate abuts against the locking protrusions via the peripheral edge portion of the decorative fabric, thereby restricting the upward movement of the presser plate. A hole to be used to sew the button on a garment or the like is provided at a leading end of the shaft portion.

With the above-described conventional configuration, the presser plate can be appropriately attached to the frame main body. On the other hand, the above-described conventional engagement structure for the frame main body and the presser plate is not suited for applications other than the use as a covered button.

SUMMARY OF THE INVENTION

The present invention was conceived in light of the above-described circumstances, and a main object thereof is to provide an ornament holder having an improved engagement structure for a frame main body and a presser plate and thus being suitable for broadening the applications.

According to a first aspect of the invention, there is provided an ornament holder provided with: a frame body including a first plate-like portion and a plurality of locking shafts extending from the first plate-like portion in a first direction; and a presser plate formed with a hole into which the plurality of locking shafts are inserted. The presser plate is attachable to the frame body. The locking shafts include first locking portions each protruding in a direction crossing the first direction. The presser plate includes first locked portions disposed adjacent to the hole and configured to engage with the first locking portions of the locking shafts. The locking shafts are elastically deformable so as to approach each other when being inserted into the hole.

In an embodiment, the plurality of locking shafts include two locking shafts spaced apart from each other in a second direction perpendicular to the first direction.

In an embodiment, each of the locking shafts is provided with a protrusion protruding in the first direction, the presser plate is provided with a pair of upright walls spaced apart from each other with the hole intervening therebetween, and each of the upright walls is provided with a second locking portion extending toward the other of the upright walls.

In an embodiment, the protrusion of each of the locking shafts is provided with a third locking portion extending away from a central axis common to the locking shafts.

In an embodiment, the first locking portions and the first locked portions are provided with rounded abutment regions, respectively. The abutment regions of the first locking portions are brought into contact with the abutment regions of the first locked portions when the locking shafts are inserted into the hole.

In an embodiment, the presser plate includes a second plate-like portion formed with the hole and a pair of movable arms configured to move relative to the secondplate- like portion. The movable arms are spaced apart from each other with the hole intervening therebetween, and each of the movable arms is defined by a first slit and a second slit both formed in the second plate-like portion, where the first slit is closer to the hole than is the second slit.

In an embodiment, each of the movable arms has a arched shape including a first end, a second end and an intermediate portion connecting the first end and the second end, where the intermediate portion is greater in thickness than each of the first end and the second end.

According to a second aspect of the invention, there is provided an ornament holder provided with: a frame body including a first plate-like portion and a locking shaft extending from the first plate-like portion in a first direction; a presser plate attachable to the frame body and formed with a hole into which the the locking shaft is inserted; and a disengagement preventing implement for holding the locking shaft in the hole. The presser plate includes a second plate-like portion formed with the hole and a pair of movable arms configured to move relative to the second plate-like portion. The movable arms are spaced apart from each other with the hole intervening therebetween. Each of the movable arms has an arched shape and is defined by a first slit and a second slit formed in the second plate-like portion, where the first slit is closer to the hole than is the second slit.

Other features and advantages of the present invention will become apparent from the detailed description given below with reference to the accompanying drawings.

DESCRIPTION OF THE PREFERRED EMBODIMENTS

Hereinafter, preferred embodiments of the present invention will be specifically described with reference to the drawings.

FIGS. 1 to 7 show an embodiment of an ornament holder according to the present invention. An ornament holder A of the present embodiment includes a frame main body 1 and a presser plate 2 to be attached to this frame main body 1, and is used to hold an ornament such as a decorative fabric.

The frame main body 1 has a plate-like portion 10 that has a substantially circular shape when viewed from above, and a plurality of (two, in the present embodiment) locking shafts 11, 12 extending from this plate-like portion 10 in a direction "z" along a central axis Ox of the plate-like portion 10.

Figure 2:
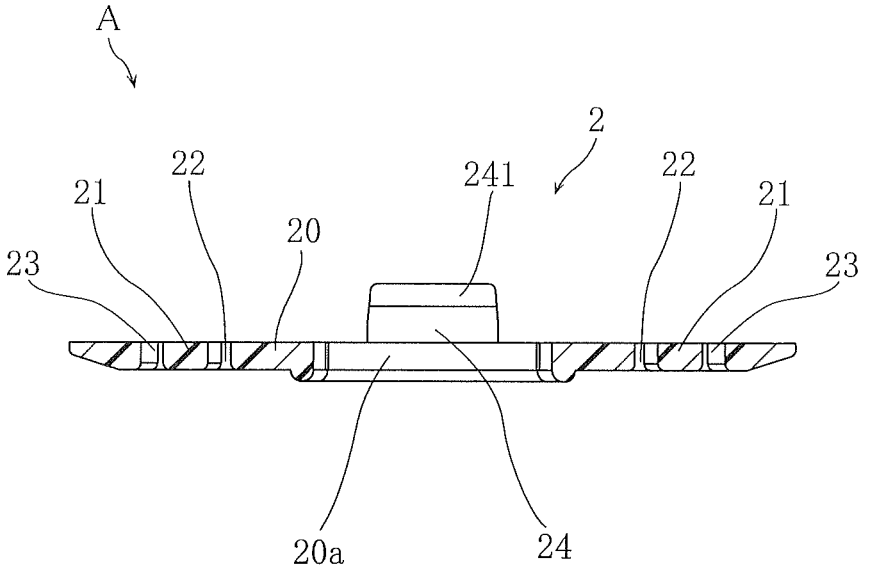
FIG. 2 is a cross-sectional view taken along line II-II in FIG. 1.
Figure 2:
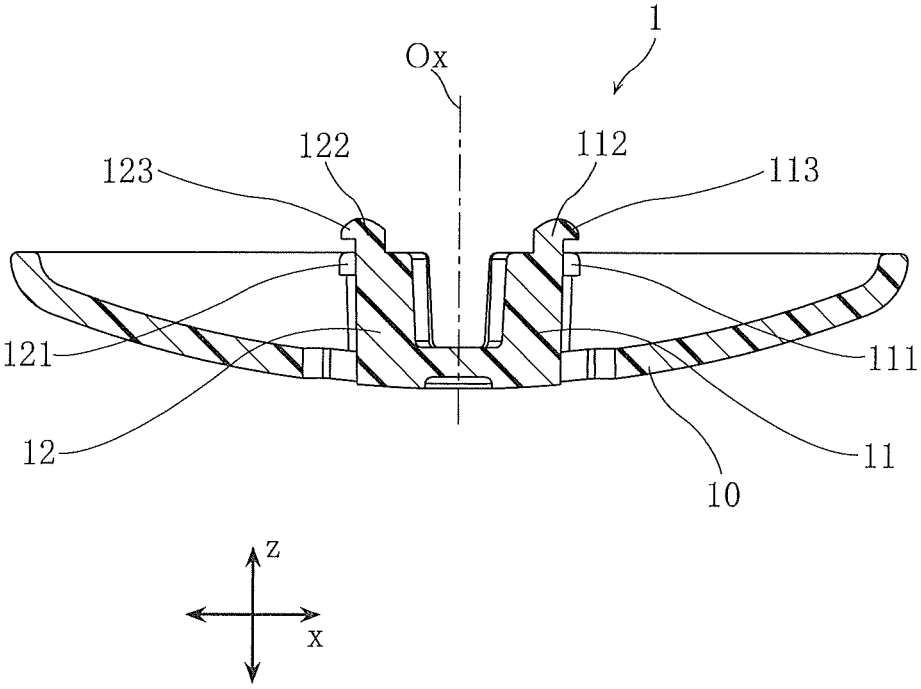

As shown in FIG. 2, the plate-like portion 10 is curved such that the deviation in the direction "z" (upward in FIG. 2) increases radially outward from the center. The two locking shafts 11, 12 are provided so as to be spaced apart from each other across the central axis Ox with respect to a direction "x" (left-right direction in FIG. 2) that is perpendicular to the direction "z" and paired with each other. The locking shafts 11, 12 have respective locking portions 111, 121 protruding in a direction that intersects the direction "z". In the present embodiment, the locking portions 111 (121) are provided at positions corresponding to two respective sides of a hexagonal hole 20*a* of the presser plate 2, which will be described later. Protrusions 112, 122 protruding in the direction "z" are provided at respective leading ends of the locking shafts 11, 12. Leading ends of the respective protrusions 112, 122 are rounded. Locking portions 113, 123 are formed at the respective protrusions 112, 122, extending away from the central axis Ox in the direction "x".

The frame main body 1 may be obtained by, for example, integrally forming a synthetic resin, such as polypropylene, having a predetermined strength.

The presser plate 2 includes a substantially disk-shaped main plate portion 20, and the hole 20*a* is formed at the center of the main plate portion 20, passing therethrough in a thickness direction. The hole 20*a* has a hexagonal shape, and during attachment of the presser plate 2 to the frame main body 1, the pair of locking shafts 11, 12 fit into this hole 20*a*. The thickness of the main plate portion 20 may be, for example, about 1 to 1.5 mm.

The main plate portion 20 (presser plate 2) is provided with two movable arms 21. The movable arms 21 are spaced apart from each other in the direction "x" and provided on opposite sides of the hole 20*a* so as to be paired with each other. Each movable arm 21 is constituted by a portion that is located between corresponding slits 22 and 23, the slits passing through the main plate portion 20 in the thickness direction. The slits 22 are provided on a side close to the hole 20*a* with respect to the corresponding movable arms 21, while the slits 23 are provided on a side away from the hole 20*a* with respect to the corresponding movable arms 21. Each of the movable arms 21 has a substantially uniform width along its length when viewed from above, and has two thin-walled connection portions or ends 211 connected to the main plate portion 20 and a curved main portion that is connected to the respective ends 211 and greater in thickness than each connection portion 211. In the illustrated example, the curved main portion (and hence the entire arm 21) is arched or U-shaped. The thickness of the thin-walled connection portions 211 may be about 0.3 mm. Each movable arm 21 can be rotated about an axis extending through the two connection portions 211 so as to be raised in the direction "z" for taking an upright position. As can be understood with reference to FIG. 11, the raised movable arm 21 forms a loop cooperating with the main plate portion 20.

Figure 1:
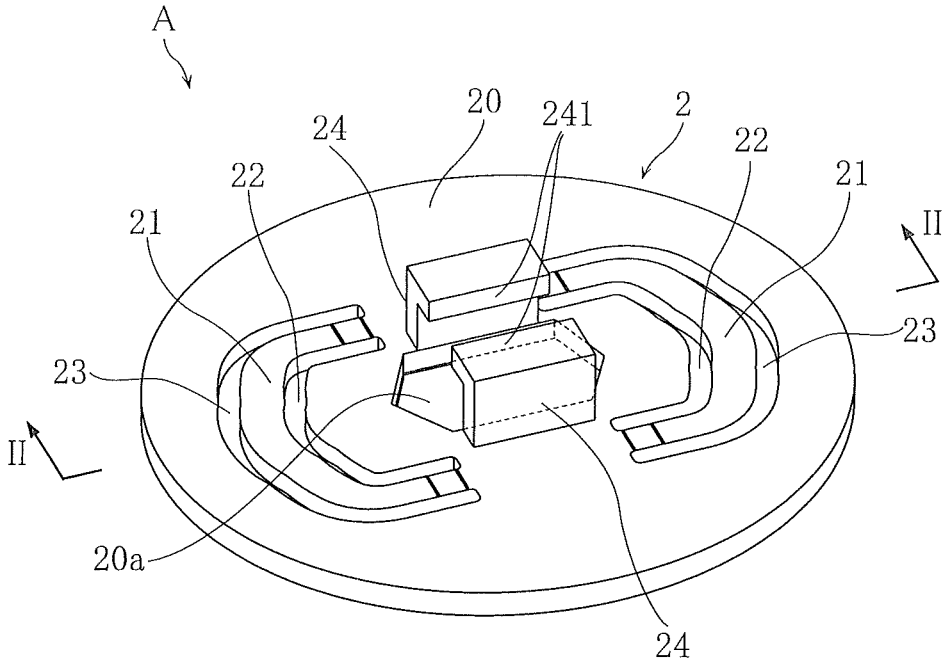
FIG. 1 is an exploded perspective view showing an example of an ornament holder according to the present invention.
Figure 1:
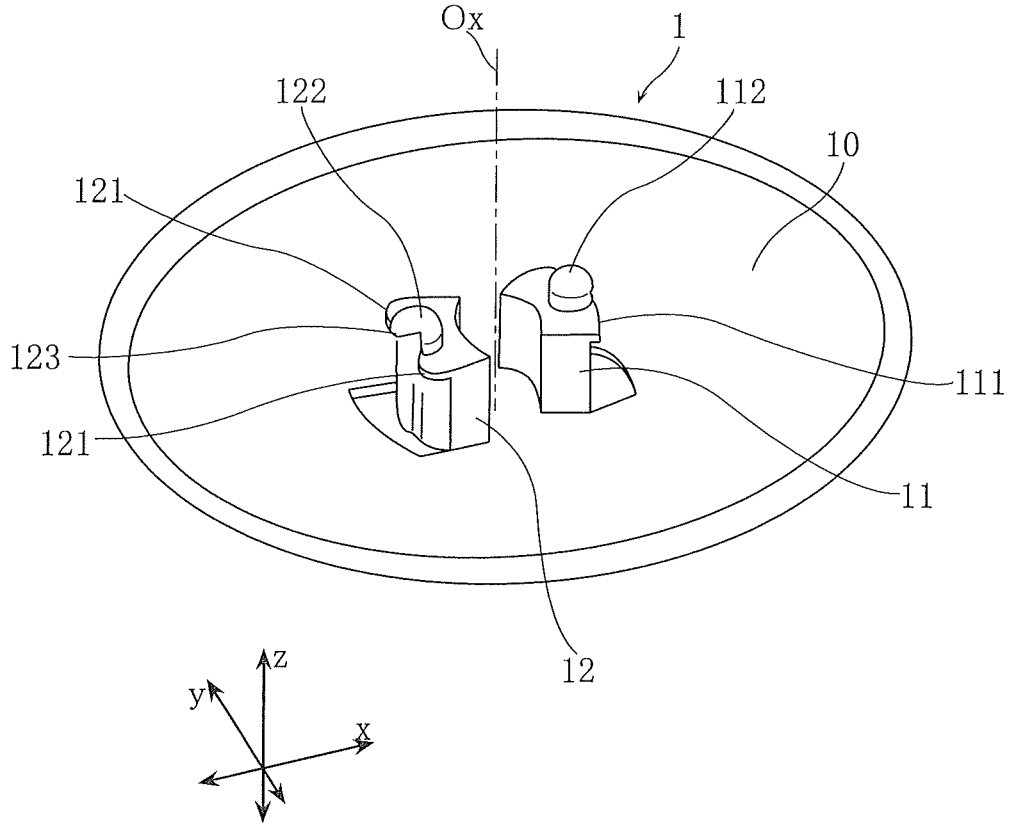
Figure 3:
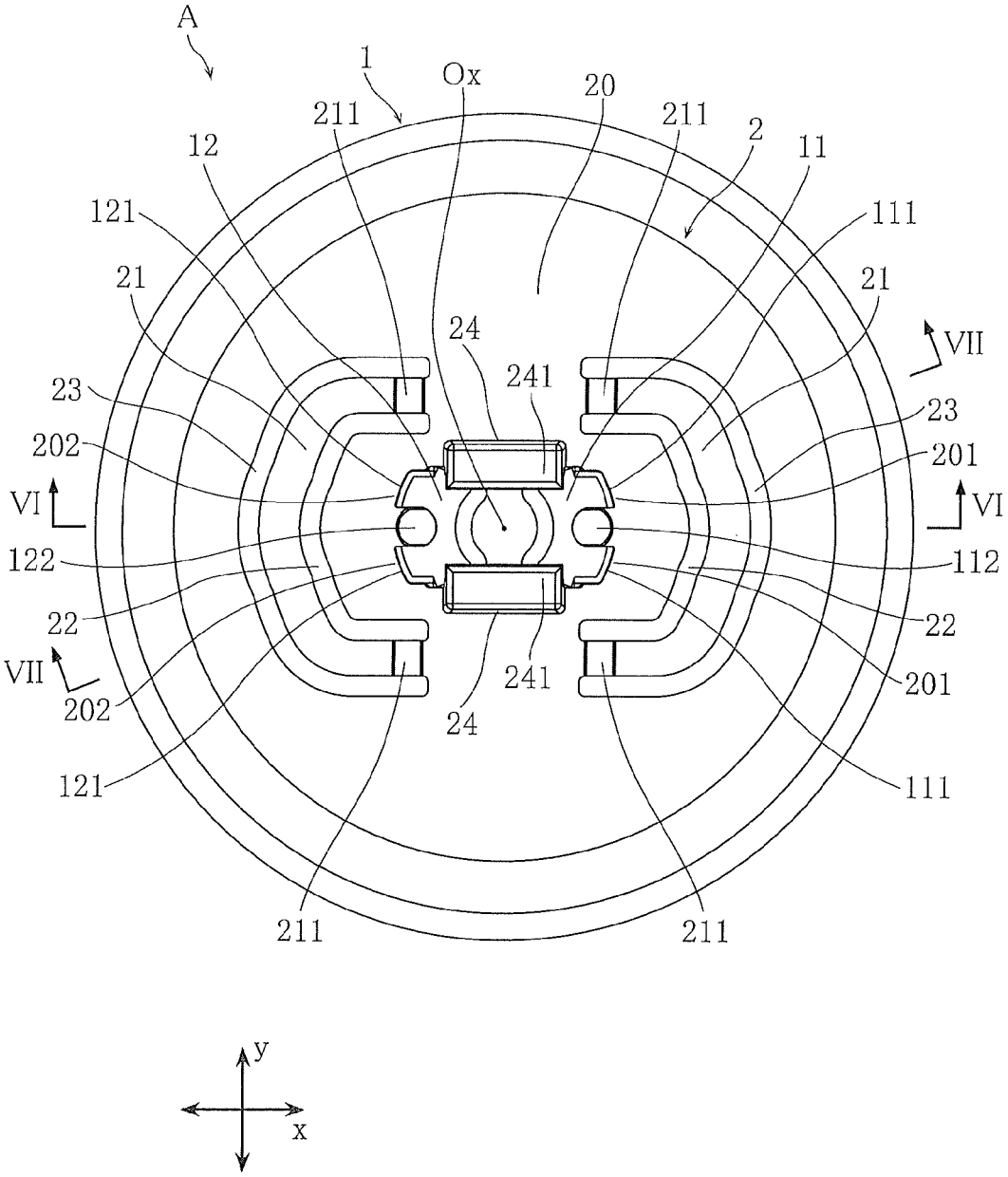
FIG. 3 is a plan view showing an assembled state of the ornament holder shown in FIG. 1.
Figure 4:
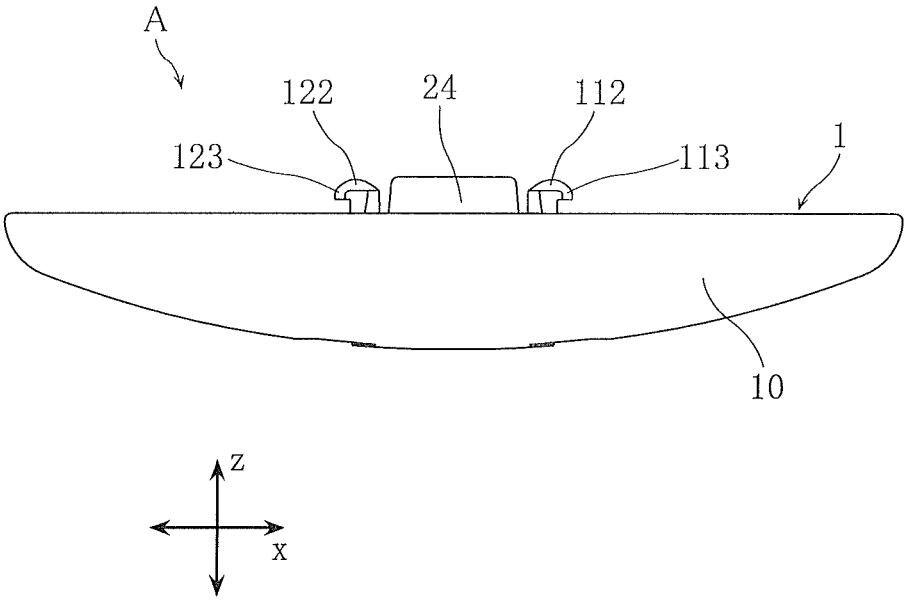
FIG. 4 is a front view of the ornament holder shown in FIG. 3.
Figure 5:
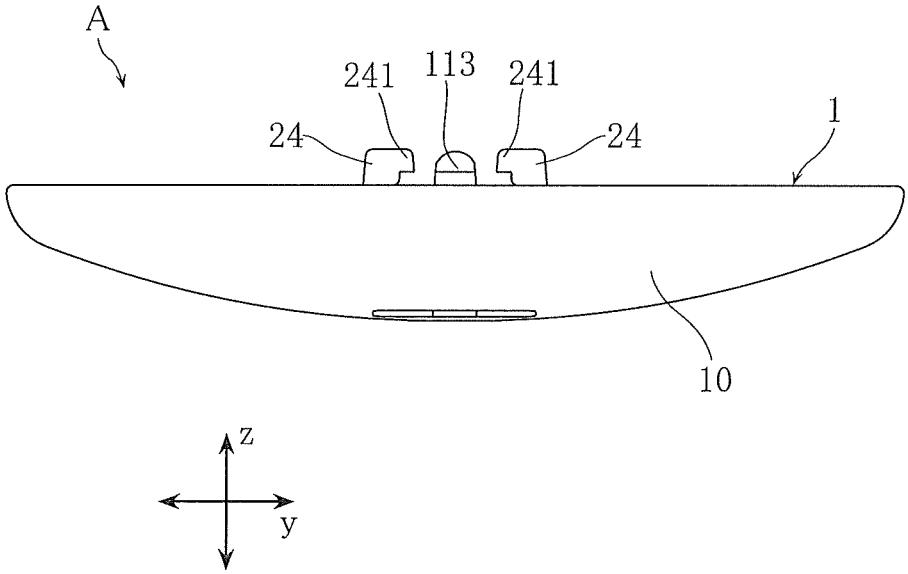
FIG. 5 is a right side view of the ornament holder shown in FIG. 3.
Figure 6:
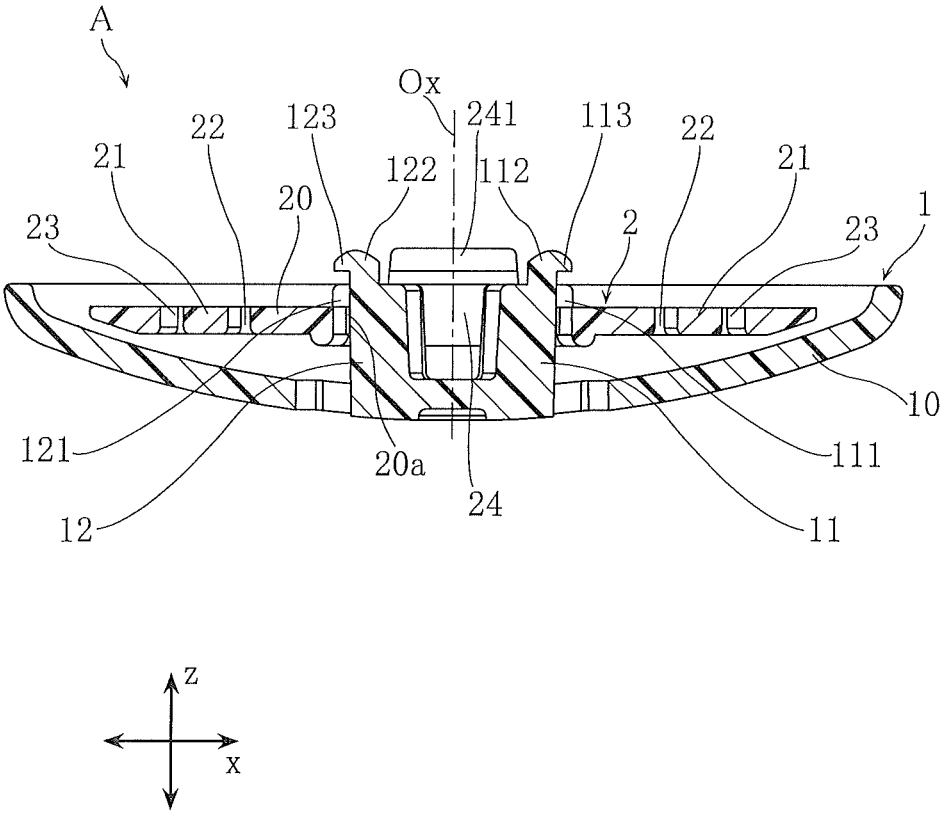
FIG. 6 is a cross-sectional view taken along line VI-VI in FIG. 3.

As can be seen in FIGS. 1, 3, 6, etc., the main plate portion 20 (presser plate 2) is provided with a pair of upwardly extending walls 24 extending in the direction "z". In a state in which the presser plate 2 is attached to the frame main body 1 (state in which the locking shafts 11, 12 are fitted into the hole 20*a*), the upwardly extending walls 24 are spaced apart from each other across the hole 20*a* with respect to a direction "y" that is perpendicular to both the direction "z" and the direction "x". A pair of locking portions 241 are provided at respective leading ends of the pair of upwardly extending walls 24, extending facing each other so as to approach each other.

The presser plate 2 may be obtained by, for example, integrally forming a synthetic resin, such as polypropylene, having a predetermined strength.

When the pair of locking shafts 11, 12 are fitted into the hole 20*a* of the main plate portion 20 (presser plate 2), an inner peripheral edge portion of the main plate portion 20 that surrounds the hole 20*a* engages with the locking portions 111, 121 of the locking shafts 11, 12, and thus disengagement of the main plate portion 20 (presser plate 2) from the locking shafts 11, 12 is restricted.

Figure 7:
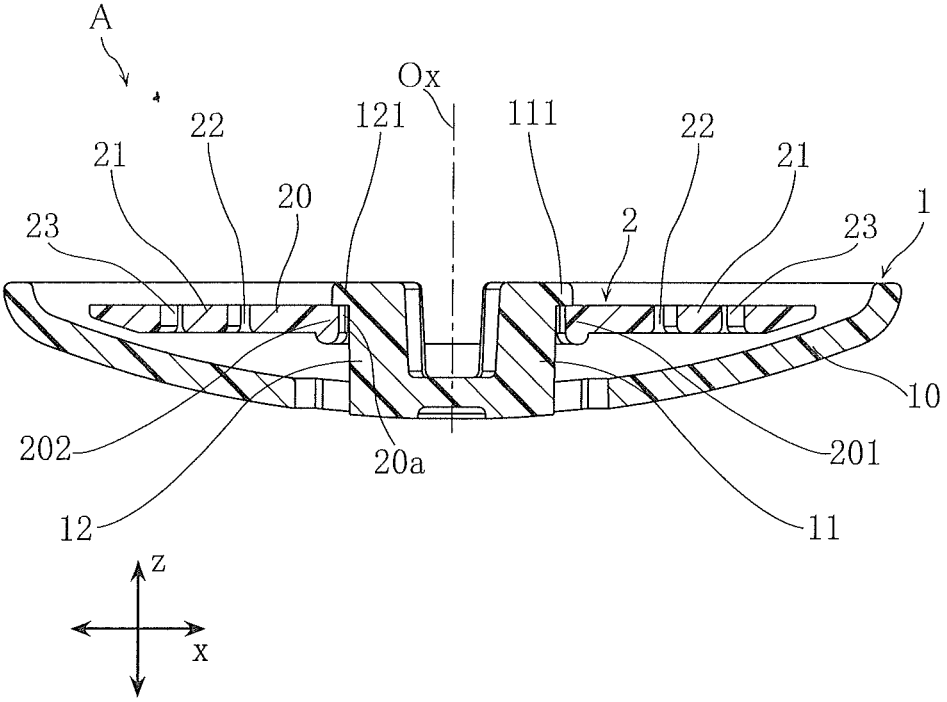
FIG. 7 is a partial cross-sectional view taken along line VII-VII in FIG. 3.

More specifically, those regions, of the inner circumferential edge portion of the main plate portion 20 that surrounds the hole 20*a*, that correspond to the respective locking portions 111, 121 of the locking shafts 11, 12 constitute locked portions 201, 202 (see FIGS. 3 and 7). In a natural state, the dimensions from the locking portions 111 of the locking shaft 11 to the respective locking portions 121 of the locking shaft 12 are set to be slightly larger than the dimensions from the locked portions 201 to the respective locked portions 202.

Figure 8:
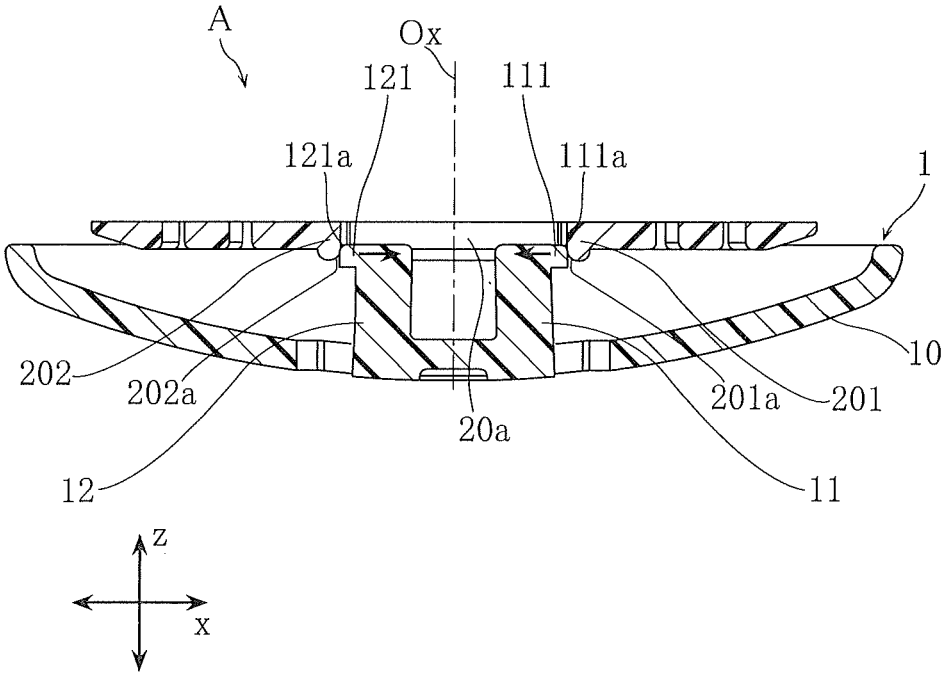
FIG. 8 is a cross-sectional view similar to FIG. 7 for explaining a procedure for attaching a presser plate to a frame main body.

During attachment of the presser plate 2 to the frame main body 1, when the main plate portion 20 (presser plate 2) is pushed down while fitting the locking shafts 11, 12 into the hole 20*a*, as shown in FIG. 8, the locking shafts 11, 12 elastically deform so as to approach the central axis Ox while the locked portions 201, 202 of the main plate portion 20 abut against the locking portions 111, 121 of the locking shafts 11, 12. In the present embodiment, the main plate portion 20 surrounding the hole 20*a* also elastically deforms so as to slightly expand. When the presser plate 2 is further pushed down, the locked portions 201, 202 pass by the locking portions 111, 121, and as shown in FIG. 7, the locking shafts 11, 12 return to the natural state due to their elastic restoring force. It should be noted that those regions (abutment regions 201*a*, 202*a* and abutment regions 111*a*, 121*a*) of the locked portions 201, 202 and the locking portions 111, 121 where the locked portions and the respective locking portions abut against each other during fitting of the locking shafts 11, 12 into the hole 20*a* are rounded. Therefore, a downward force that is exerted to push the presser plate 2 down is transformed to a lateral force, and thus a force in directions (directions of the arrows in FIG. 8) toward the central axis can be efficiently applied to the locking shafts 11, 12. When the presser plate 2 has been attached to the frame main body 1 in this manner, even if an attempt to move the presser plate 2 upward is made, the locking portions 111, 121 of the pair of locking shafts 11, 12 engage with the locked portions 201, 202 of the main plate portion 20 (presser plate 2), and thus the movement of the presser plate 2 is restricted.

Next, several manners in which the ornament holder A having the above-described configuration is used and the effects thereof will be described with reference to FIGS. 9 to 13.

The ornament holder A of the present embodiment can be used for a plurality of applications, and may be used as, for example, a covered button, a brooch, and a hair ornament.

Figure 9:
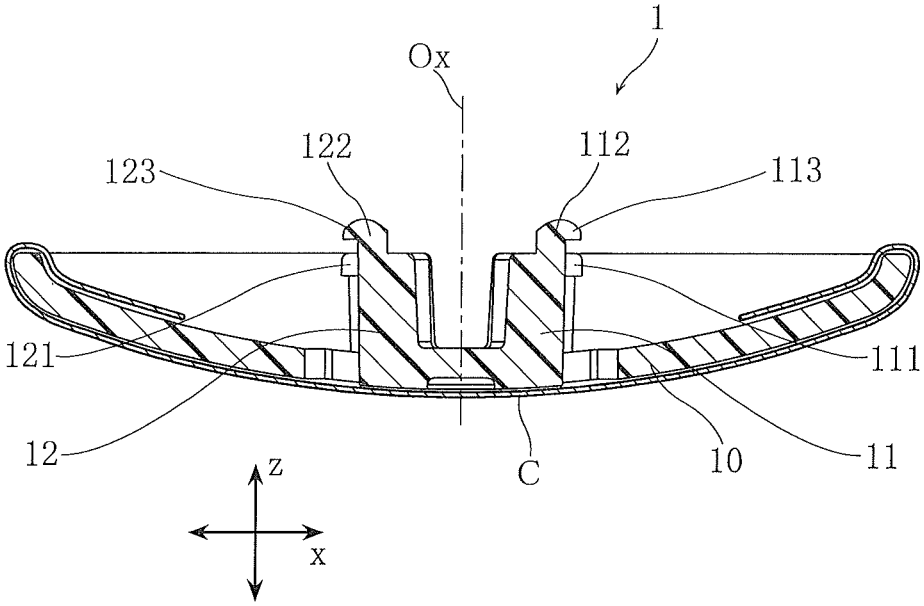
FIG. 9 is a cross-sectional view for explaining a manner in which the ornament holder is used.

A case where the ornament holder A is used as a covered button will be described. As shown in FIG. 9, a surface (lower surface in FIG. 9) of the main plate portion 10 of the frame main body 1 is covered with, for example, a decorative fabric C, and a peripheral edge portion of that decorative fabric C is folded toward the inside of the main plate portion 20. It should be noted that it is also possible to sew a running stitch around the peripheral edge portion of the decorative fabric C in advance, if necessary. In this case, when the thread is pulled after the decorative fabric C is put on the frame main body 1, generation of wrinkles on the decorative fabric C can be suppressed.

Figure 10:
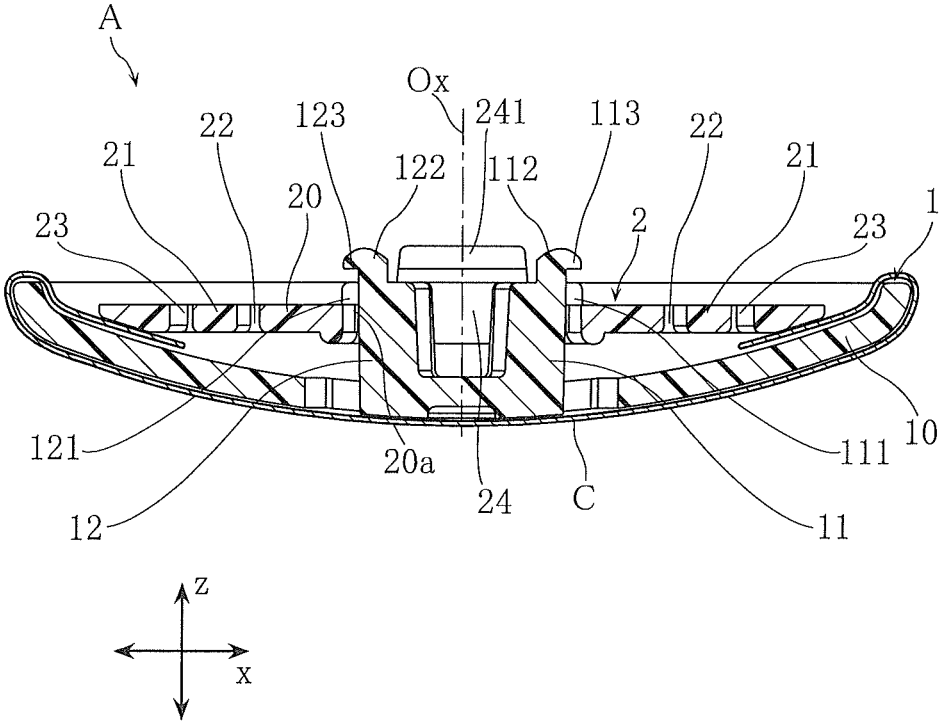
FIG. 10 is a cross-sectional view for explaining the manner in which the ornament holder is used.

Next, the presser plate 2 is attached to the frame main body 1. The presser plate 2 is attached by pushing down the main plate portion 20 (presser plate 2) while fitting the locking shafts 11, 12 of the frame main body 1 into the hole 20*a* of the presser plate 2. As shown in FIG. 10, in a state in which the presser plate 2 is attached, the peripheral edge portion of the decorative fabric C is present between the plate-like portion 10 and the presser plate 2.

Figure 11:
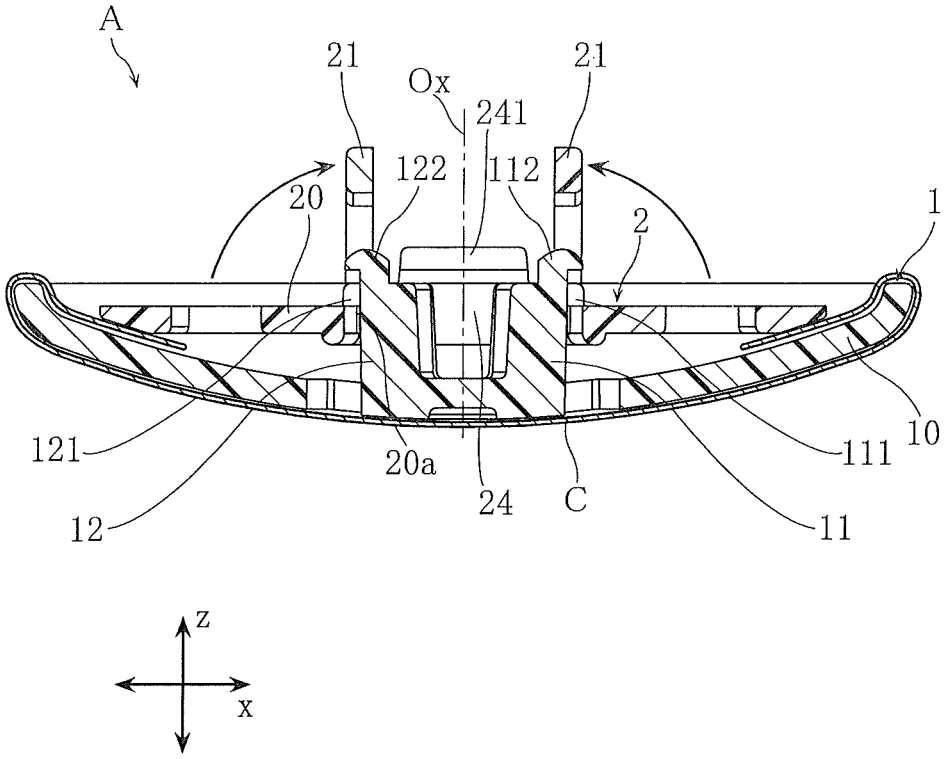
FIG. 11 is a cross-sectional view for explaining the manner in which the ornament holder is used.

Next, as shown in FIG. 11, the pair of movable arms 21 are raised so as to individually forma loop. The movable arms 21 can be used as holes through which thread is passed to sew the ornament holder A (covered button) on a garment or the like.

Figure 12:
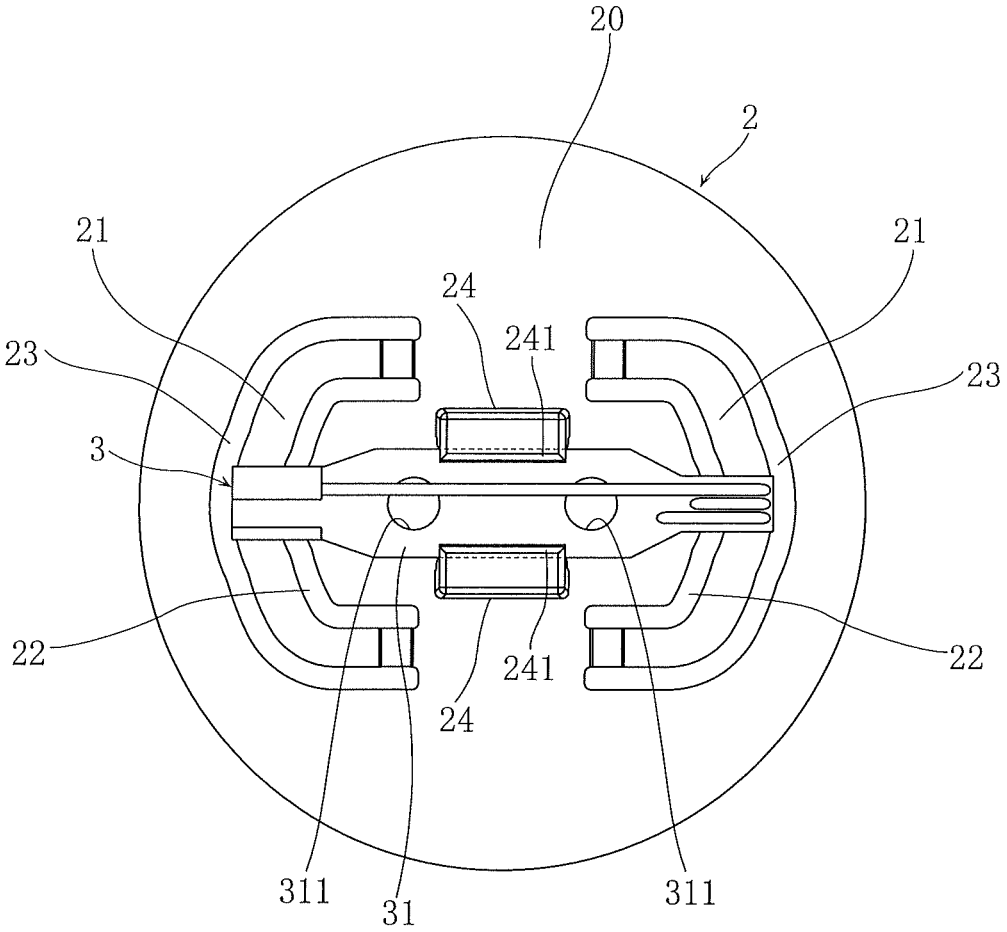
FIG. 12 is a plan view for explaining a manner in which the ornament holder is used.
Figure 13:
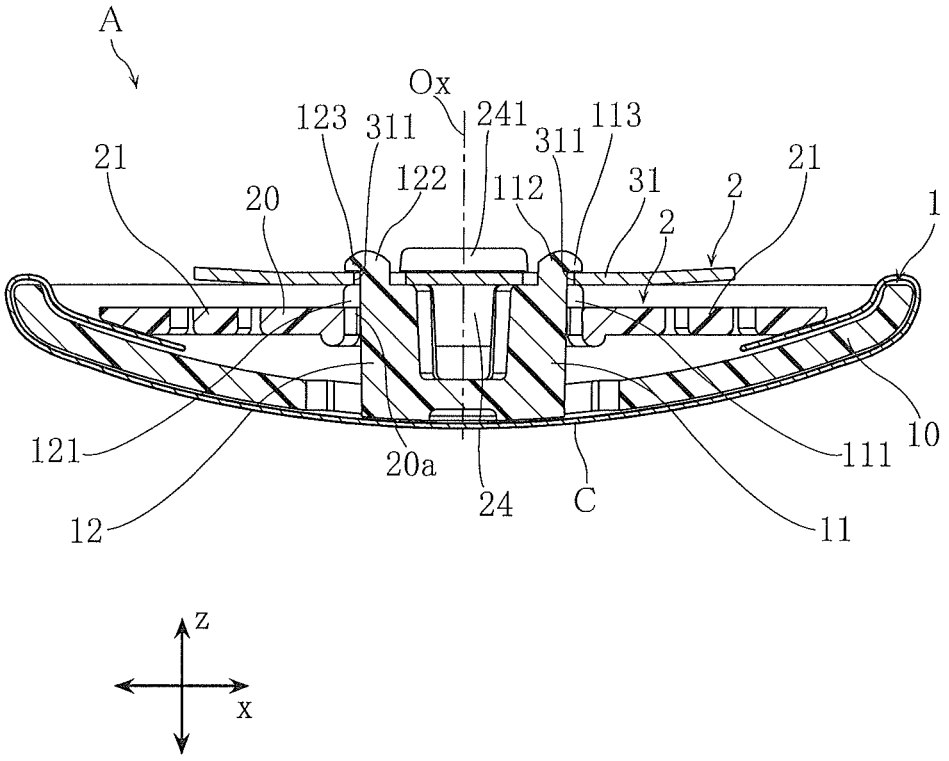
FIG. 13 is a cross-sectional view of a relevant portion for explaining the manner in which the ornament holder is used.

Next, a case where the ornament holder A is used as a brooch will be described. In the case where the ornament holder A is used as a brooch, the ornament holder A is fitted with a metal fitting for a brooch. First, as shown in FIG. 12, a metal fitting 3 is placed on the presser plate 2 (main plate portion 20) between the pair of upwardly extending walls 24. The metal fitting 3 has an attachment portion 31 having a predetermined width and extending in a fixed direction. The width of the attachment portion 31 is smaller than the dimension between the upwardly extending walls 24 and larger than the dimension between the locking portions 241. Moreover, a pair of attachment holes 311 are formed at respective positions in the attachment portion 31 that are spaced apart from each other in a longitudinal direction thereof, the attachment holes passing through the attachment portion 31 in a thickness direction thereof. Although the details will be described later, the attachment holes 311 constitute portions into which the respective protrusions 112, 122 of the presser plate 2 are fitted.

Next, the presser plate 2 on which the metal, fitting 3 is placed is attached to the frame main body 1 fitted with the decorative fabric C. Here, the distance between the centers of the attachment holes 311 of the metal fitting 3 is slightly smaller than the distance between the centers of the protrusions 112, 122 of the presser plate 2 in the natural state. Moreover, the size of each attachment hole 311 is slightly larger than the size of a cross section of the corresponding protrusion 112 (122) that is perpendicular to a height direction thereof.

During attachment of the presser plate 2 to the frame main body 1, the presser plate 2 is pushed down together with the metal fitting 3 while the locking shafts 11, 12 of the frame main body 1 are fitted into the hole 20*a* of the presser plate 2. Then, as the locking shafts 11, 12 approach the central axis Ox, the distance between the centers of the protrusions 112, 122 at the leading ends of the locking shafts 11, 12 also slightly decreases, and the protrusions 112, 122 are thus fitted in the pair of attachment holes 311. When the presser plate 2 is further pressed down, the locked portions 201, 202 pass by the respective locking portions 111, 121, and thus the locking shafts 11, 12 return to the natural state due to their elastic restoring force (see FIG. 13). With respect to the metal fitting 3 shown in FIG. 13, displacement in the direction "x" is suppressed by the protrusions 112, 122 fitted in the respective attachment holes 311, and disengagement is prevented by the locking portions 113, 123 provided at the respective protrusions 112, 122. Moreover, both ends of the attachment portion 31 with respect to a width direction thereof are covered by the locking portions 241, which extend facing each other from the respective upwardly extending walls 24, and thus disengagement of the metal fitting 3 is also prevented by the locking portions 241.

Therefore, according to the present embodiment, the metal fitting 3 can be fitted to the ornament holder A by a simple operation of pushing down the metal fitting 3 together with the presser plate 2. Moreover, the thus fitted metal fitting 3 is firmly fixed to the ornament holder A by the cooperation of the locking portions 113, 123 and the locking portions 241, and thus a robust brooch can be provided.

Next, a case where the ornament holder A is used as a hair ornament will be described. In the case where the ornament holder A is used as a hair ornament, the same procedure as that in the case where the ornament holder A is used as a covered button, which has been described above with reference to FIGS. 9 to 11, is performed to achieve the state shown in FIG. 11. Here, with respect to the pair of movable arms 21, since a relatively large space is formed between the main plate portion 20 and each movable arm 21, a hair tie having a diameter of, for example, about 3 to 4 mm can be passed therethrough. When a hair tie is passed through the movable arms 21 and wound around the hair, the ornament holder A can be used as a hair ornament.

As described above, according to the ornament holder A of the present embodiment, since the engagement structure for the frame main body 1 and the presser plate 2, or the like is designed with some contrivance, the ornament holder A can be used for a plurality of applications.

While a specific embodiment of the present invention has been described above, the present invention is not limited to the foregoing embodiment, and various modifications are possible without departing from the gist of the invention. It should be understood that specific shapes and materials of the ornament holder according to the present invention also are not limited to those described in the foregoing embodiment.

In the foregoing embodiment, a case where the frame main body 1 has a circular shape has been described.

However, the shape of the frame main body may also be other shapes such as, for example, an elliptical shape.

Examples of the ornament to be held by the ornament holder according to the present invention include various embroidery works such as wool embroidery and beads embroidery and decorative fabrics such as patchwork, as well as handicraft works such as knits and beaded fabrics, and furthermore, soft articles having relatively small thicknesses.

The invention claimed is:

1. An ornament holder, comprising:

a frame body including a first plate portion and a plurality of locking shafts extending from the first plate portion in a first direction; and a presser plate formed with a hole into which the plurality of locking shafts are inserted, the presser plate being attachable to the frame body;

wherein the locking shafts include first locking portions each protruding in a direction crossing the first direction, the presser plate includes first locked portions disposed adjacent to the hole and configured to engage with the first locking portions of the locking shafts, the locking shafts are elastically deformable so as to approach each other when being inserted into the hole, the presser plate includes a second plate portion formed with the hole and a pair of movable arms configured to move relative to the second plate portion, the movable arms being spaced apart from each other with the hole intervening therebetween, each of the movable arms being defined by a first slit and a second slit both formed in the second plate portion, the first slit being closer to the hole than is the second slit, the first slit and the second slit for each of the movable arms are spaced apart from the hole, and each of the movable arms has an arched shape including a first end, a second end and an intermediate portion connecting the first end and the second end, the intermediate portion being greater in thickness than each of the first end and the second end.

2. The ornament holder according to claim 1, wherein the plurality of locking shafts include two locking shafts spaced apart from each other in a second direction perpendicular to the first direction.

3. The ornament holder according to claim 2, wherein each of the locking shafts is provided with a protrusion protruding in the first direction, the presser plate is provided with a pair of upright walls spaced apart from each other with the hole intervening therebetween, and each of the upright walls is provided with a second locking portion extending toward the other of the upright walls.

4. The ornament holder according to claim 3, wherein the protrusion of each of the locking shafts is provided with a third locking portion extending away from a central axis common to the locking shafts.

5. The ornament holder according to claim 1, wherein the first locking portions and the first locked portions are provided with rounded abutment regions, respectively, the abutment regions of the first locking portions being brought into contact with the abutment regions of the first locked portions when the locking shafts are inserted into the hole.

6. An ornament holder, comprising:

a frame body including a first plate portion and a locking shaft extending from the first plate portion in a first direction;

a presser plate formed with a hole into which the locking shaft is inserted, the presser plate being attachable to the frame body; and a disengagement preventing implement for holding the locking shaft in the hole;

wherein the presser plate includes a second plate portion formed with the hole and a pair of movable arms configured to move relative to the second plate portion, the movable arms being spaced apart from each other with the hole intervening therebetween, each of the movable arms being defined by a first slit and a second slit formed in the second plate portion, the first slit being closer to the hole than is the second slit, the first slit and the second slit for each of the movable arms are spaced apart from the hole, and each of the movable arms has an arched shape including a first end, a second end and an intermediate portion connecting the first end and the second end, the intermediate portion being greater in thickness than each of the first end and the second end.

* * * * *